US009084336B2

(12) United States Patent
Mous

(10) Patent No.: US 9,084,336 B2
(45) Date of Patent: Jul. 14, 2015

(54) HIGH CURRENT SINGLE-ENDED DC ACCELERATOR

(75) Inventor: Dirk Jozef Willem Mous, Nieuwegein (NL)

(73) Assignee: High Voltage Engineering Europa B.V., Amersfoort (NL)

( * ) Notice: Subject to any disclaimer, the term of this patent is extended or adjusted under 35 U.S.C. 154(b) by 0 days.

(21) Appl. No.: 13/368,787

(22) Filed: Feb. 8, 2012

(65) Prior Publication Data

US 2012/0256564 A1 Oct. 11, 2012

(30) Foreign Application Priority Data

Feb. 8, 2011 (EP) ..... 11153703

(51) Int. Cl.
*H05H 7/00* (2006.01)
*H05H 5/02* (2006.01)

(52) U.S. Cl.
CPC ..... *H05H 5/02* (2013.01)

(58) Field of Classification Search
USPC ..... 250/492.1, 493 R, 494; 315/505, 506
See application file for complete search history.

(56) References Cited

U.S. PATENT DOCUMENTS 3,845,312 A 10/1974 Allison, Jr.
4,128,764 A * 12/1978 Luce ..... 250/398
4,383,180 A * 5/1983 Turner ..... 250/492.2
5,631,526 A * 5/1997 Ferry ..... 315/506
5,661,366 A * 8/1997 Hirota et al. ..... 315/5.41
5,729,028 A 3/1998 Rose
5,777,209 A 7/1998 Tien
7,429,743 B2 9/2008 Kabasawa et al.
7,498,588 B1 * 3/2009 Gordon et al. ..... 250/424
8,232,747 B2 * 7/2012 Crewson et al. ..... 315/505

(Continued)

FOREIGN PATENT DOCUMENTS

EP 0833549 A1 4/1998
JP 0227300 A 1/1990

(Continued)

OTHER PUBLICATIONS

E Cottereau, DC accelerators by E. Cottereau (2009) https://web.archive.org/web/20090704085036/http://cas.web.cern.ch/cas/Pruhonice/PDF/DC-accel-DB1.pdf.*

(Continued)

*Primary Examiner* — Douglas W Owens
*Assistant Examiner* — Srinivas Sathiraju
(74) *Attorney, Agent, or Firm* — Robert L. Stearns; Dickinson Wright, PLLC

(57) ABSTRACT

A single-ended DC linear accelerator for the generation of high-current, high-energy ion beams of H, D or He includes an ion source located in a high-voltage terminal for the creation of the ion beam, an analyzing magnet to purify the ion beam, an accelerating tube and DC high-voltage power supply for accelerating the ions of interest to high energies and a separate pumping tube that transports the vast majority of the neutral gas from the ion source at high-voltage towards a vacuum pump at ground potential, thereby preventing the adverse influence of increased vacuum pressure inside the accelerating tube to facilitate stable acceleration of high-current beams to high energies in single-ended DC linear accelerators. The resulting high-current accelerator for H, D or He has diverse applications, including ion beam cancer therapy, cyclotron injection, silicon cleaving, ion implantation in semiconductor devices and NRA.

20 Claims, 4 Drawing Sheets

(56) References Cited

U.S. PATENT DOCUMENTS

| | | | | |
|---|---|---|---|---|
| 8,508,158 | B2 * | 8/2013 | Cleland et al. | 315/501 |
| 2009/0206275 | A1 * | 8/2009 | Henley et al. | 250/424 |
| 2010/0033115 | A1 * | 2/2010 | Cleland et al. | 315/501 |
| 2012/0161672 | A1 * | 6/2012 | Cleland et al. | 315/502 |

FOREIGN PATENT DOCUMENTS

| | | | |
|---|---|---|---|
| JP | 5299197 | A | 11/1993 |
| WO | 2008025737 | A1 | 3/2008 |

OTHER PUBLICATIONS

Wills, J.S.C., et al., "A Compact High-Current Microwave-Driven Ion Source", Reviews of Scientific Instruments, Jan. 1, 1998, pp. 65-68, vol. 69, No. 1, United States of America.

Cox, S.A., et al., "Performance of the ANL Dynamitron Tandem", IEEE Transactions on Nuclear Science USA, Jun. 1971, pp. 108-112, vol. 18, No. 3, United States of America.

Cleland, M.R., et al., "Dynamag Ion Source With Open Cylindrical Extractor", IEEE Transactions on Nuclear Science, Jun. 1967, pp. 60-64, vol. NS-14, No. 3, United States of America.

Kellog, E.M., "Ion-Gas Collisons During Beam Acceleration", IEEE Transactions on Nuclear Science, 1965, pp. 242-246, vol. NS-12, No. 3, United States of America.

Cleland, M.R., et al., "Dynamitrons of the Future", IEEE Transactions on Nuclear Science, Mar. 10-12, 1965, pp. 227-234, vol. NS-12, No. 3, United States of America.

Cleland, M.R., et al., "The Prospects for Very High-Power Electron Accelerators for Processing Bulk Materials", Radiation Physics and Chemistry, 1977, pp. 547-566, vol. 9, Nos. 4-6, United States of America.

Cleland, M.R., et al., "High Power DC Electron Accelerators for Industrial Applications", Radiation Dynamics, Inc., Jun. 26-28, 1979, pp. 1-31, Presented at the 3rd All-Union Conference on Applied Accelerators, Leningrad, USSR.

Cleland, M.R., et al., "Acceleration of Intense Positive Ion Beams at Megavolt Potentials", IEEE Transactions on Nuclear Science, Jul. 1969, pp. 113-116, vol. NS-16, No. 3, United States of America.

M. Von Ardenne, Tabellen der Electrophysik, Ionenphysik und Ubermikroskopie I, V.E.B. Deutcher Verlag der Wissenschaften, 544-549 (1956).

C. D. Moak, et al., Duoplasmatron Ion Source for Use in Accelerators, Rev. Sci. Instrum. 30, 694 (1959).

M. R. Cleland, The Dynagen IV Fast Neutron Therapy System, Proceedings of the Work-Shop on Practical Clinical Criteria for a Fast Neutron Generator, Tufts-New England Medical Center, Boston, Mass., 178-189 (1973).

B. P. Offermann, Neutron-Therapy Unit for the Universitätskrankenhaus Hamburg-Eppendorf Radiologische Universitätsklinik, Proceedings of the Work-Shop on Practical Clinical Criteria for a Fast Neutron Generator, Tufts-New England Medical Center, Boston, Mass., 67-86 (1973).

B. Cleff et al., A New 2 MV Single-Ended Ion Accelerator for Ion Implantation, Nuclear Instruments and Methods in Physics Research B6, 46-50, North-Holland, Amsterdam (1985).

A. Gottdang, et al., The Novel HVEE 5 MV Tandetron, Nuclear Instruments and Methods in Physics Research B 190, 177-182 (2002).

European Search Report dated Jul. 5, 2011 (EP11153703).

* cited by examiner

HIGH CURRENT SINGLE-ENDED DC ACCELERATOR

This application claims priority to European Patent Application No. 11153703.1, filed Feb. 8, 2011, and is incorporated herein by reference.

BACKGROUND

The present invention relates to single-ended electrostatic DC linear particle accelerators. Such accelerators are well known and have been commercially available for more than 50 years to generate MeV electrons and ions. The ease with which the particle energy can be varied over a large range covering several tens of keV up to several tens of MeV, its unparalleled sharp energy definition and beam quality and their relative simple operating principle are the main reasons for their continuing widespread use today. The early accelerators were built in vessels that contained a pressurized gas to isolate the high voltage DC potential. A moving belt continuously transports charge that is sprayed onto its surface towards the terminal, thereby maintaining it at a high voltage potential. These belt driven DC linear electrostatic accelerators are named after their inventor, R. J. Van de Graaff and have limited current capability of typically less than ~1 mA.

The beam current capability of the MeV DC linear accelerators was increased by several mA by changing the mechanical belt-driven high-voltage power supply by an electronic power supply. Probably the most successful example of such a pure electronic power supply that is applied for megavolt DC linear accelerators is the so-called Dynamitron power supply. Dynamitron-type power supplies are often referred to as parallel-coupled multiplier cascades to indicate their resemblance with today's standard and widespread approach of generating high voltage by serial-coupled multiplier cascades. In conjunction with accelerators serial-coupled multiplier cascaded high-voltage power supplies are often referred to as Cockroft-Walton type power supplies after their inventors J. D. Cockcroft and E. T. S. Walton.

In the case of electron accelerators the ongoing developments of Dynamitrons led to very powerful and high-current machines. Today many Dynamitron-based electron accelerators routinely provide electron beam intensities of several tens of mA and beam powers in excess of 100 kW to serve diverse industrial applications.

In spite of the growing demand by various applications and substantial effort, early high expectations that the availability of high-current DC power supplies and high-intensity ion sources would lead to the availability of several MeV ion beams at tens of mA intensity, never really matured. Examples of these applications include research in astrophysics and cancer therapy. Today, there is an even broader range of applications that would benefit from high-intensity ion beams of H, D or He, including cancer therapy, of which BNCT may be the best example, cyclotron injection, silicon cleaving for e.g. solar cell production, ion implantation in semiconductor devices and NRA for e.g. the detection of explosives.

In short, the reason that the progress in increasing beam current came to a halt can be explained as follows. The increase in primary beam current from the ion source inevitably resulted in the release of more neutral gas from these sources. The neutral gas from the ion source will increase the vacuum pressure inside the acceleration tube that accelerates the primary ion beam. Inside this acceleration tube the interaction of the primary ion beam with neutral gas atoms or molecules will result in several undesirable effects.

First of all, ionization of the neutral gas creates charged particles (ions and electrons) within the acceleration tube and these charged particles will be accelerated by the electrostatic field in the tube. The charged particles in turn will end up on the electrodes of the tube which will upset its field distribution. This in turn will affect the stability and voltage holding capability of the acceleration tube, possibly resulting in a full breakdown of the high voltage.

Secondly, scattering of primary particles on the neutral gas atoms will change their direction within the acceleration tube so that a part of the primary ions will end up on the electrodes of the acceleration tube. This is a second contribution to the reduced voltage holding capability of the acceleration tube.

These obstacles that were limiting the beam current capability are long understood and well described. See for example: US application # US 2010/0033115 and references therein.

Further references are:

B. Cleff, W.-H. Schulte, H. Schulze, W. Terlau, R. Koudijs, P. Dubbelman and H. J. Peters, A new 2 MV single-ended ion accelerator for ion implantation, Nucl. Instr. and Meth. in Phys. Res. B6 (1985) 46-50

A. Gottdang, D. J. W. Mous and R. G. Haitsma, The novel HVEE 5 MV Tandetron™ Nucl. Instr. and Meth. in Phys. Res. B190 (2002) 177-182

The understanding of the physical phenomena that hampered the increase of ion beam current motivated the design of new accelerators that addressed the underlying problems. These designs include the incorporation of a vacuum pump and a vacuum restriction in the high-voltage terminal, mass analysis before acceleration to ensure that only the ions of interest are accelerated and the application of ion sources with high ionization efficiency to optimize the ratio between the primary ion beam current and the release of neutral gas. There are many examples of DC linear accelerators that are equipped with a vacuum pump and mass analysis inside the high-voltage terminal, see e.g.: B. Cleff, W.-H. Schulte, H. Schulze, W. Terlau, R. Koudijs, P. Dubbelman and H. J. Peters, A new 2 MV single-ended ion accelerator for ion implantation, Nucl. Instr. and Meth. in Phys. Res. B6 (1985) 46-50 and the earlier mentioned US application.

Apart from reasons with regard to technical functionality, it is a practical shortcoming of a configuration that has a vacuum pump in the terminal in that it requires periodic regeneration of the accumulated gas, which is time-consuming and results in system downtime.

In spite of the efforts described above, a clear breakthrough towards currents of tens of mA has not been convincingly demonstrated. Such a breakthrough would widen the field of applications for DC linear accelerators in many directions that are mentioned before. As an example, the availability of a 2-3 MeV proton accelerator system with a beam current capability of roughly 20 mA would pave the road towards the clinical application of Boron Neutron Capture Therapy (BNCT) since such high beam current brings the duration of the treatment within acceptable limits. It is believed that the reduction of the vacuum pressure inside the acceleration tube is the key towards higher currents.

SUMMARY

A high-current (more than 5 mA) accelerator system is provided in which the gas that is inevitably released from the high-current ion source is efficiently pumped before it can flow into the acceleration tube. The resulting low vacuum pressure inside this acceleration tube supports high-current beams to be accelerated.

The need for regular and time-consuming regeneration of the vacuum pump in the terminal is circumvented in order to minimize system downtime.

A DC single-ended linear accelerator that may be powered from a Dynamitron-type power supply capable of producing MeV ion beams in excess of 5 mA is disclosed. For this, a ion source to generate the primary ion beam is located in its high-voltage terminal. Suitable ion sources should have low maintenance and long lifetime since servicing of the ion source requires a time-consuming tank opening and causes accelerator downtime. Sources that are well known and widely available may include Duoplasmatrons, microwave or ECR ion sources. The high-voltage terminal further comprises a vacuum enclosure in which the high-current ion beam from the ion source is transported towards the accelerating tube and which houses a mass-analyzer to remove unwanted contaminants from the primary ion beam. The mass-analyzer may be configured such that it also acts like a lens that focuses the divergent beam emerging from the ion source to become convergent. In this way a beam focus or "waist" is created after mass analysis. The mass-analyzer may be a 90 deg dipole magnet with appropriately shaped magnet poles to provide the required focusing. This arrangement allows that a vacuum restriction in the form of a plate or a wall with a small sized aperture is placed at the position of the beam focus. The aperture allows passage of the mass analyzed ion beam towards the acceleration tube and at the same time blocks the neutral gas from entering into the acceleration tube. Connected in between the vacuum enclosure in the high voltage terminal and the vacuum pump at ground potential is a separate pumping tube that can withstand the full accelerator high voltage. The neutral gas from the ion source can flow via the vacuum enclosure through the pumping tube towards ground potential where it is further removed from the system by a vacuum pump.

BRIEF DESCRIPTION OF THE DRAWINGS

These and other features and advantages will be discussed in more detail hereafter with reference to the drawings, wherein like parts are numbered alike in the various figures. The figures are intended to illustrate an exemplary embodiment but are in no way intended to limit the scope of the present invention, in which.

DESCRIPTION OF PRIOR ART

Figure 1:
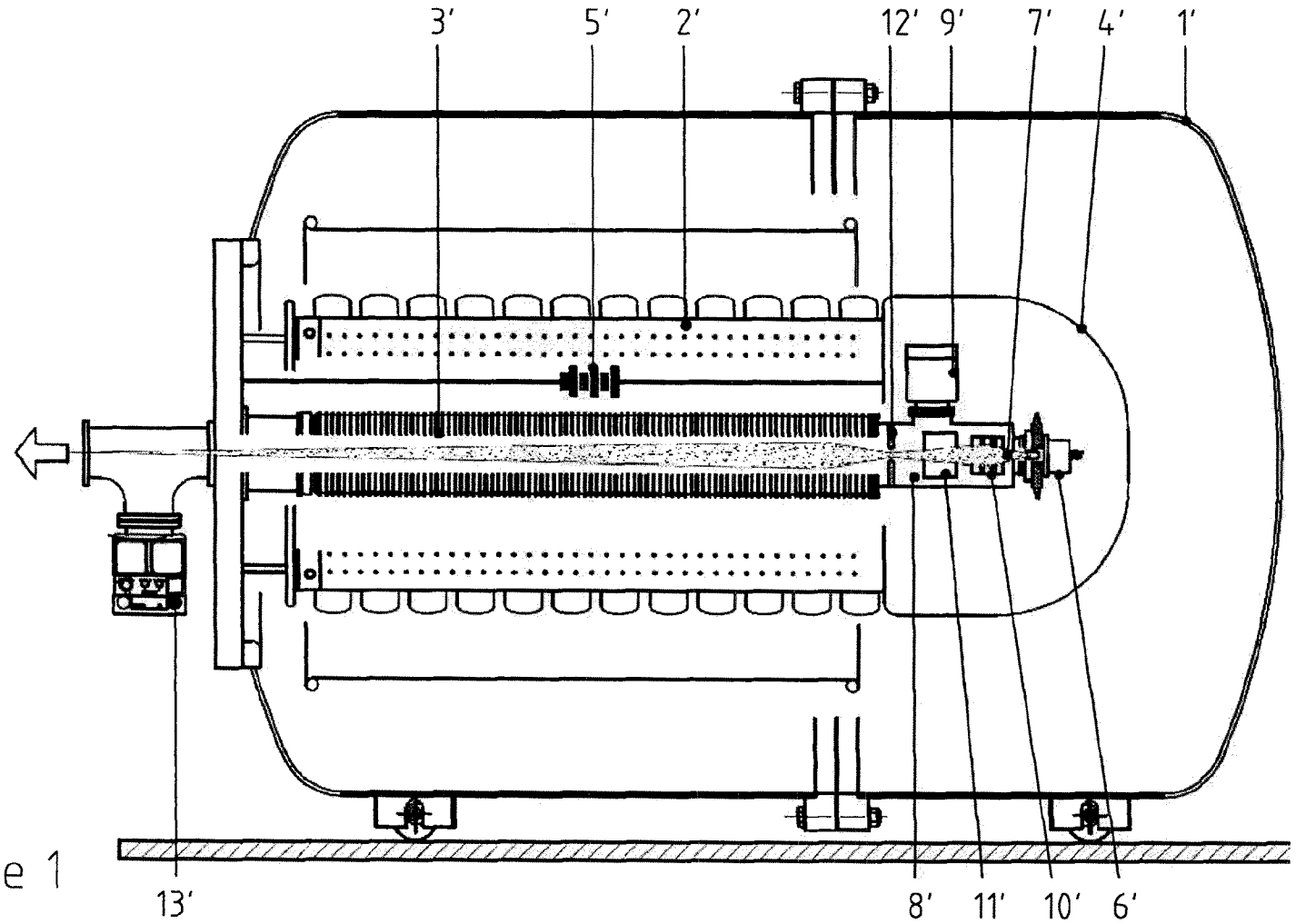
Figure 1 Prior Art
FIG. 1 shows a known particle accelerator having a vacuum pump and a mass-analyzer in its terminal.

FIG. 1 shows the embodiment of a known accelerator. A steel vessel 1' contains an insulating gas at a pressure of several bars and further comprises an accelerating column 2', an accelerating tube 3' and a terminal 4' that is maintained at a high voltage of up to several MV by a suitable high-voltage DC power supply 5', shown schematically in FIG. 1. In the terminal gas is fed into an ion source 6' in which a low pressure plasma consisting of ionized particles is maintained. Through a small extraction hole in the plasma chamber ions are extracted by an electrostatic field to form a well defined stream of ionized particles referred to as the "ion beam" 7'. Besides the ion beam, neutral gas flows from the plasma chamber into a vacuum enclosure or manifold 8'. It is known that the ion sources commonly applied in DC linear accelerators have ionization efficiencies in the order of 3-30%. As a result, only a small fraction of the gas that is fed into the ion source contributes to ion beam formation and so the vast majority of the gas must be pumped away to maintain the required vacuum level. In the embodiment of FIG. 1, this is achieved by a vacuum pump 9' located inside the high-voltage terminal 4', in close vicinity to the ion source 6'. After extraction, the primary ion beam 7' is focused by an ion-optical lens 10', such as an Einzellens, in order to control its size and to optimize its transmission. Before injection into the acceleration tube 3', the ion beam passes a mass-analyzer 11' that removes contaminants from the primary ion beam 7' to prevent the acceleration of these unwanted particles. Such a mass-analyzer 11' may be in the form of an ExB filter, often referred to as Wien filter, or in the form of a bending magnet. After the lens 10' and mass-analyzer 11', but in front of the acceleration tube a vacuum restriction 12' is located that is usually in the form of a plate or wall having an aperture or orifice in it that allows passage of the beam towards the acceleration tube 3'. In this way the vast majority of the neutral gas finds its way into the vacuum pump 9' instead of flowing into the acceleration tube 3'. In this way the pressure inside the acceleration tube 3' is maintained at a low level. After the vacuum restriction 12', the beam is injected into the acceleration tube 3' in which it is accelerated before leaving the accelerator at MeV energies. The acceleration tube 3' consists of a plurality of conducting electrodes separated from each other by insulating rings providing an essentially axially directed electrostatic field that serves to accelerate the ion beam along its axis. The vacuum in the acceleration tube 3' is maintained at a low level by a vacuum pump at ground potential 13'. The embodiment of FIG. 1 and variations thereof are well known and have been described in detail in literature, not necessarily solely related to the requirement of high beam current, but also related to beam purity requirements and to minimize the adverse consequences of a high vacuum pressure inside the acceleration tube on the voltage holding capability and the life-time of the accelerating tube. See, for instance, the earlier mentioned publication of Cleff et al.

Although attractive from a vacuum point of view, it is readily recognized by those skilled in the art that the configuration of FIG. 1 has its shortcomings for high-current ion beam transport because of its use of electrostatic elements like an Einzellens and an ExB mass-analyzer that are known to have a detrimental effect on the efficient transport of high-current ion beams.

In addition to this, the vacuum pump that is located in the high-voltage terminal will have to store the gas that it collects. As a consequence and regardless of the selected type of pump, it requires periodic regeneration of the accumulated gas, which is time-consuming and results in system downtime.

DETAILED DESCRIPTION

A steel vessel 1 contains insulating gas at a pressure of several bars and further comprises an accelerating column 2, an accelerating tube 3 and a terminal 4 that is maintained at a high voltage of up to several MV by a high voltage power supply. In this example the high voltage is generated by a Dynamitron-type power supply, that is the power supply of the preferred embodiment, but alternatives including Cockroft-Walton and magnetically-coupled high-voltage DC power supplies are possible. The operating principle of the Dynamitron-type power supply can be concisely described as follows: Two dynodes 14 that have a semi-cylindrical shape are excited by a sinusoidal RF voltage of typically 20-200 kV. The RF voltage is capacitively coupled to crescent shaped corona rings 15. Rectifier assemblies 16 are placed between opposing corona ring 15 and are connected in series to create an essentially DC high voltage that increases linearly along the length of the accelerator column 2 in the direction of the high-voltage terminal. This type of power supply is widely applied and its technological details are well understood. It has been commercially available from several different manufactures for many decades. See for example: A. Gottdang, D. J. W. Mous and R. G. Haitsma, The novel HVEE 5 MV Tandetron™, Nucl. Instr. and Meth. in Phys. Res. B 190 2002 177-182 and the earlier mentioned US application and references therein.

Figure 3:
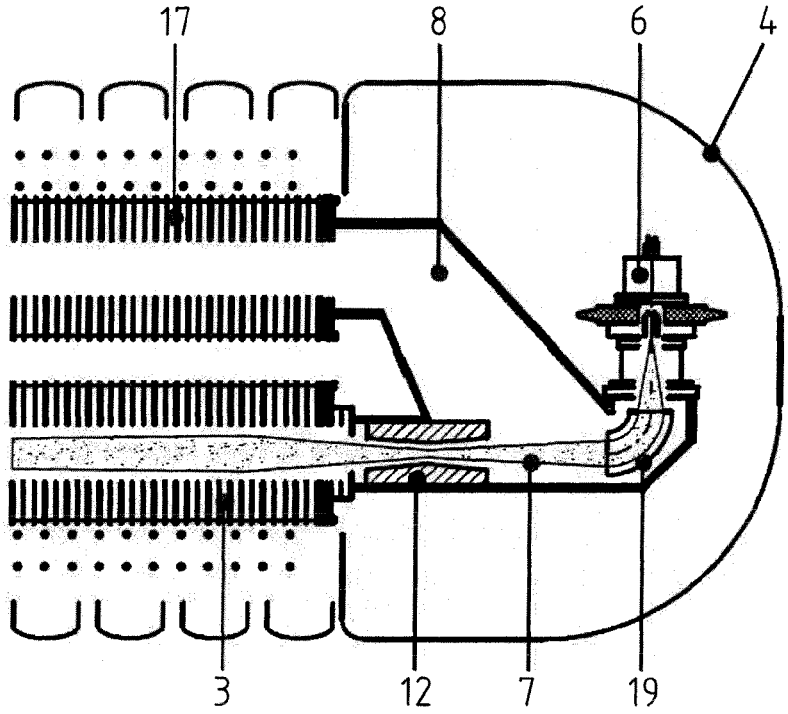
FIG. 3 shows the details of the high-voltage terminal of the preferred embodiment according to the present invention.

Referring to FIG. 3, the high-voltage terminal 4 comprises at least an ion source 6 having an extraction hole from which the primary ion beam 7 is extracted, some sort of vacuum enclosure or manifold 8 in which the ion beam 7 from the ion source 6 is transported to the entrance of the accelerator tube 3, means to mass-analyze the primary ion beam 7 in order to purify the beam, means to maintain a low enough vacuum pressure level within the vacuum enclosure 8 and a vacuum restriction 12 with low conductance to minimize the flow of gas into the acceleration tube 3.

Several issues have to be taken into account to make the design successful.

Firstly, it is readily recognized by those skilled in the art that the high-current at least 5 mA ion beam 7 that is required mandates that space charge compensation be maintained during the transport of the ion beam 7 from the ion source 6 to the entrance of the acceleration tube 3. Space charge compensation cancels the repulsive forces between positive ions in the beam by allowing negative electrons to populate the beam envelope where they compensate the charge of the ion beam. This in turn reduces the repulsive forces. Cancelation of these repulsive forces prevents blow-up of the beam and is therefore beneficial for efficient beam transport. Preservation of space charge compensation is increasingly important at higher beam currents. It is known to those skilled in the art that space charge compensation excludes the use of electrostatic components like Einzellenses and ExB mass-analyzers.

Secondly, the vacuum restriction 12 that is located between the ion source 6 and the entrance of the acceleration tube 3 and that is in the form of a plate or wall which has an aperture or orifice to allow passage of the ion beam, is effective in minimizing the amount of gas that flows into the acceleration tube 3. This is achieved when the aperture or orifice has a small area, but is optimally achieved when the vacuum restriction 12 is in the form of a small diameter tube, as shown in FIG. 3, large enough for transmission of the beam, but at the same time small and long to effectively block the gas. Clearly, a small beamsize at the location of the vacuum restriction 12 helps to achieve a low vacuum conductance.

In the preferred embodiment the requirements of a configuration that supports space charge compensated beam transport and a small beamsize at the position of the vacuum restriction 12 for efficient blocking of the gas is achieved by a strong focusing magnet dipole 19. It is well understood that by a proper choice and design of the radius, index, bending angle and geometry of the magnet poles, the analyzing dipole magnet 19 will be able to focus the beam and to create a small sized beam at the position of the vacuum restriction 12.

It is readily recognized by those skilled in the art that a relative small bending angle of e.g. 30° may be sufficient to meet the requirements for mass analysis, but that a substantially larger bending may be required to achieve the needed strong focusing action because the focal power of a bending magnet increases with its bending angle. As a result, the bending angle of the magnet according to the preferred embodiment of the invention is at least 45°, but optimally it 90°, as shown in FIG. 3. Those skilled in the art readily recognize this ion optical configuration in which the small beamsize at the extraction hole of the source 6 is imaged to a small focus or "beam waist" downstream the 90° dipole magnet 19. As a result, this set-up allows that the diameter of the opening in the vacuum restriction 12 is made small, typically comparable to, but in any case less than two times, the diameter of the extraction hole in the plasma chamber of the ion source 6. In the preferred embodiment, the vacuum restriction 12 is made in the form of a small sized tube, possibly tapered to follows the envelope of the beam, as shown in FIG. 3. It has a low vacuum conductance and effectively blocks the gas in the direction of the acceleration tube 3.

Figure 4:
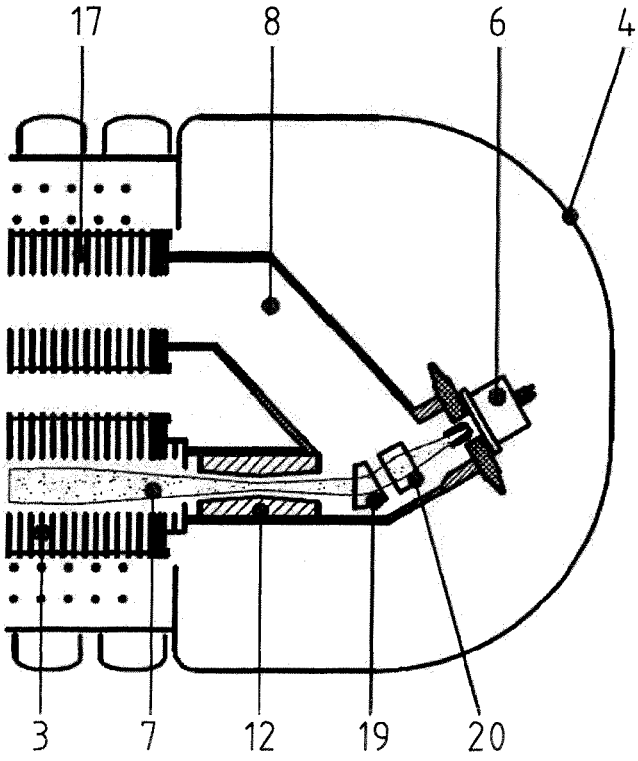
FIG. 4 shows the details of the high-voltage terminal of an alternative embodiment according to the present invention.

An alternative configuration that may be applied is given in FIG. 4. In this set-up, the required focusing power to create a focus in between the ion source 6 and the acceleration tube 3 is achieved by an additional magnetic lens 20. A magnetic quadrupole doublet or triplet generally referred to as quadrupole multiplet, or a solenoid may be used for the required focusing action. In FIG. 4 the magnetic lens is placed in front of the magnetic dipole, but the position of the lens 20 and the dipole magnet 19 may be interchanged while keeping essentially the same functionality.

Figure 2:
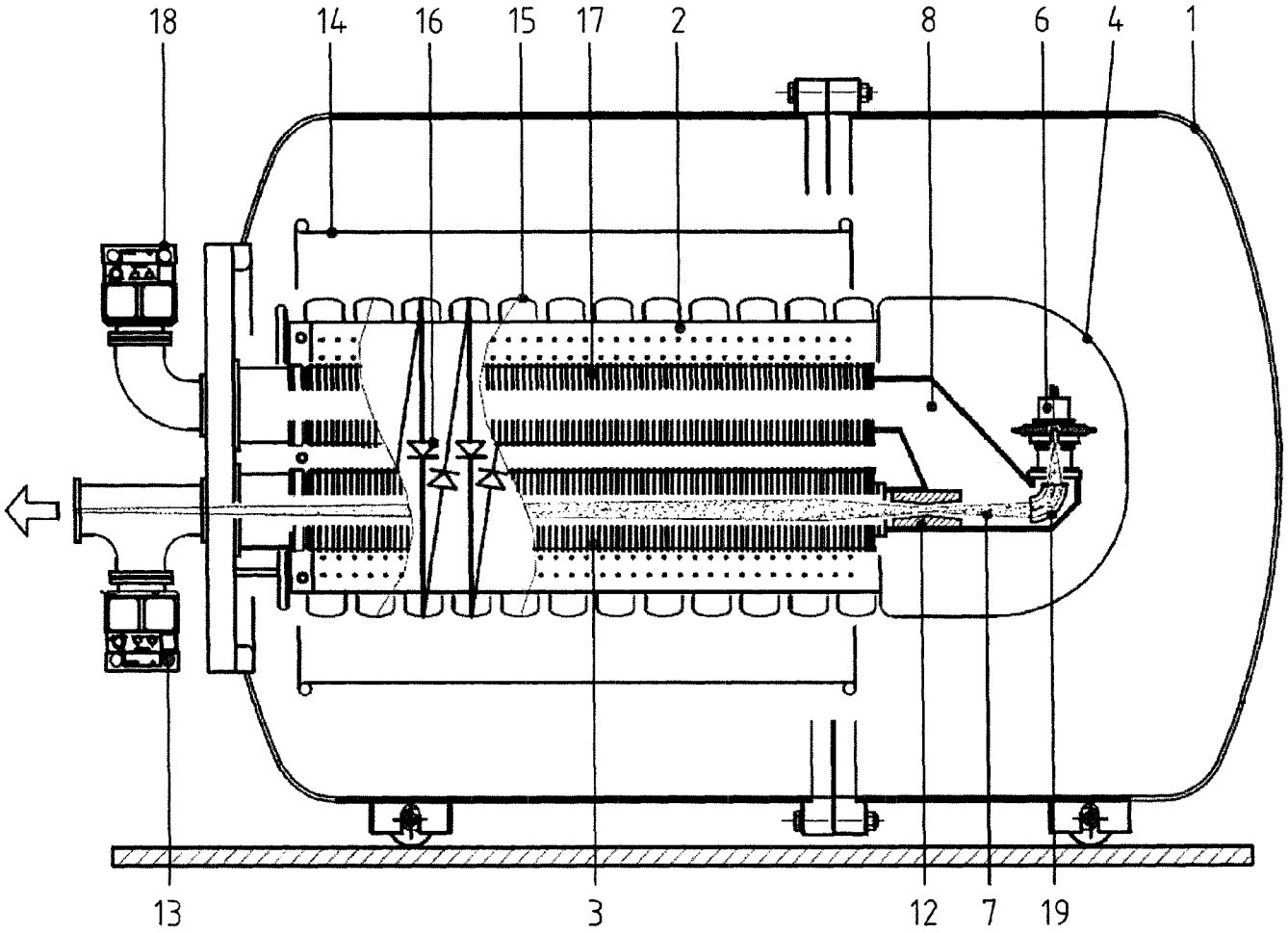
FIG. 2 shows the preferred embodiment of an accelerator system according to the present invention.

In the accelerator, pumping of the neutral gas from the ion source 6 has a special arrangement. Instead of mounting the vacuum pump directly on the vacuum enclosure 8 in the high-voltage terminal 4, which is characteristic for prior art, a dedicated pumping tube 17 is positioned in between the ion source 6 at high voltage and the vacuum pump 18 at, or close to, ground potential, as shown in FIG. 2. The gas from the ion source 6 is transported via the vacuum enclosure 8 and the entrance of the pumping tube 17 that are located at high voltage, towards the exit of the pumping tube 17 at, or close to, ground potential where it is finally removed from the system by a vacuum pump 18 outside the accelerator main vessel 1. Clearly, this implies that the pumping tube 17 should be capable to withstand the full accelerator high voltage, similar to the acceleration tube 3. In fact, the addition of the pumping tube has created two separate tubes, both of which should be capable of withstanding the full high-voltage, but each with its own functionality and requirements: The acceleration tube 3 capable of transporting the high current ion beam, able to cope with ionization and other unwanted physical phenomena, and the pumping tube 17 with optimal vacuum conductance for an efficient transport of the gas towards the vacuum pump at ground potential with minimal restriction. Both acceleration tube 3 and pumping tube 17 can now be optimized for their individual tasks with fewer constraints, which will enhance overall system performance.

It is another advantage that a greater freedom of choice is obtained with regard to the dimensions and the type of vacuum pump to be used, because usually more space is available for such an externally mounted pump and the pump does not need to operate in a pressurized environment. In addition, regeneration of the vacuum pump, which would result in system downtime, is no longer needed.

Figure 5:
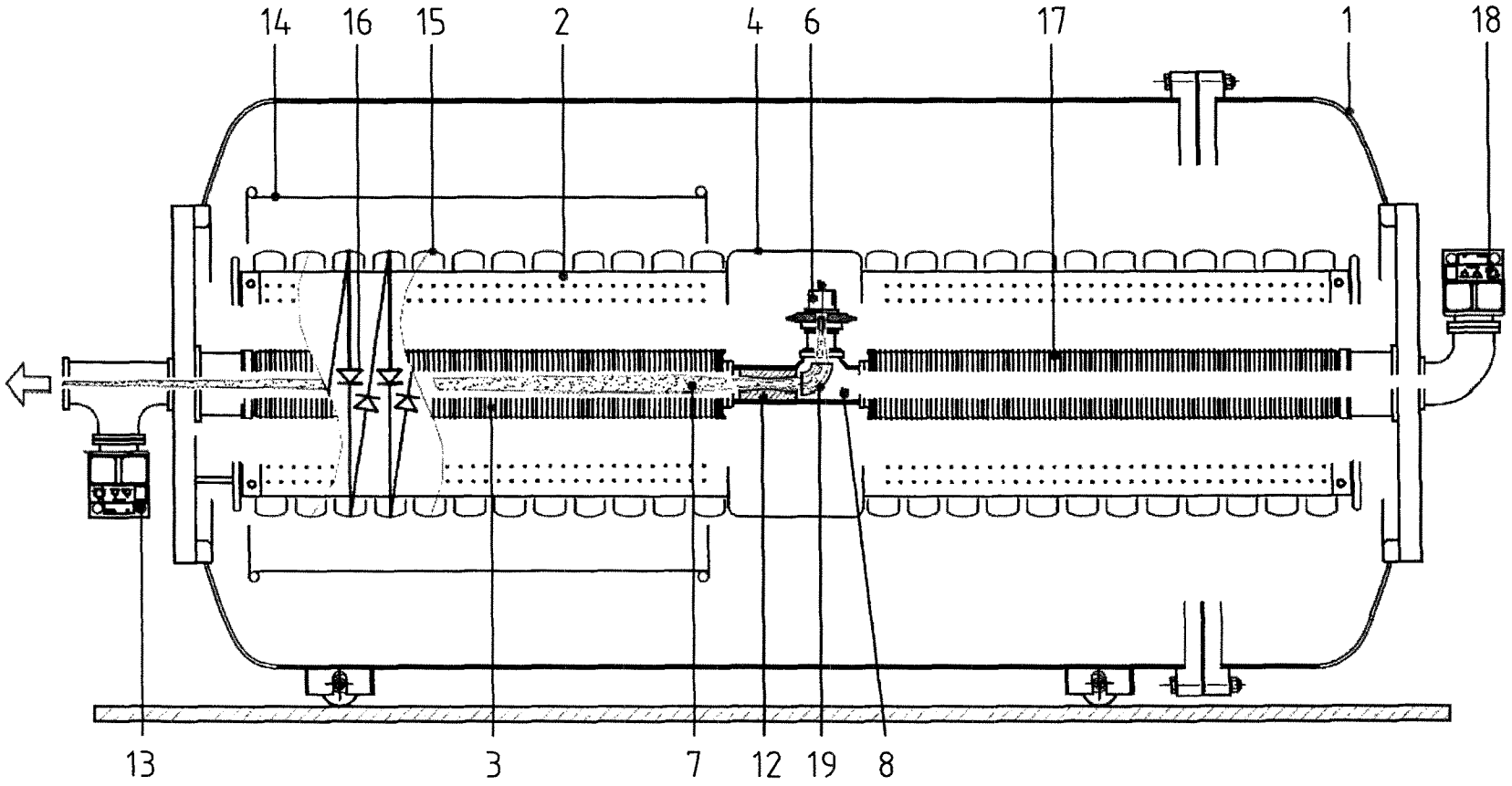
FIG. 5 shows an alternative embodiment of an accelerator system according to the present invention.

In the preferred embodiment of FIG. 2, the acceleration tube 3 and pumping tube 17 are mounted close to each other and parallel. However, other configurations may well be possible. For example FIG. 5 shows an alternative accelerator configuration. in which the acceleration tube 3 and the pumping tube 17 are mounted opposite each other and essentially in-line on one common axis.

There will be various modifications, adjustments, and applications of the disclosed invention that will be apparent to those of skill in the art, and the present application is intended to cover such embodiments. Accordingly, while the present invention has been described in the context of certain preferred embodiments, it is intended that the full scope of these be measured by reference to the scope of the following claims.

The invention claimed is:

1. An accelerator system capable of producing a high-current, high-energy ion beam of more than 5 mA and more than 500 keV, comprising:

a high-voltage terminal maintained at a voltage of up to several MV;

an accelerating tube having a plurality of electrodes separated by insulating rings providing an essentially axially directed electrostatic field that serves to accelerate said ion beam along its axis, a high voltage DC power supply maintaining said high voltage terminal at the voltage of up to several MV and providing the high voltage potential required to generate said electrostatic field for said accelerating tube, an ion source located at said high-voltage potential in said high voltage terminal to generate said ion beam that emerges from its extraction hole, a vacuum enclosure disposed in said high voltage terminal and connecting said ion source and said accelerating tube, a magnetic analyzer located in between said ion source and said accelerating tube for the removal of unwanted contaminants in said ion beam, a pumping tube extending from a high voltage end connected to said vacuum enclosure to an exit; and a vacuum pump located outside of said high voltage terminal and connected to said exit of said pumping tube in order to pump neutral gas released from said ion source and transported through said pumping tube to prevent said neutral gas from flowing into said accelerating tube.

2. The accelerator system as in claim 1, wherein said vacuum pump is maintained at greund-pete4al a lower voltage than said voltage of said high-voltage terminal.

3. The accelerator system as in claim 1 wherein said high-voltage DC power supply is a Dynamitron-type power supply.

4. The accelerator system as in claim 1 wherein said ion source is selected form anyone of: a Duo-plasmatrons, a microwave ion source or an ECR ion source.

5. The accelerator system as in claim 1 further comprising a vacuum restrictor located in between said ion source and an entrance of said accelerating tube to further reduce the flow of said neutral gas released from said ion source into the accelerating tube.

6. The accelerator system as in claim 5, wherein said vacuum restrictor is in the form of a plate or wall having an aperture for the passage of said ion beam.

7. The accelerator system as in claim 5, wherein said vacuum restrictor is in the form of a tube with a diameter less than 2 times the extraction hole of said ion source.

8. The accelerator system as in claim 7, wherein said tube has tapered walls to follow the envelope of said ion beam.

9. The accelerator system as in claim 1, wherein said magnetic analyzer consists of a dipole magnet.

10. The accelerator system as in claim 9, characterized in that said dipole magnet has a bending angle in between 450 and 1200.

11. The accelerator system as in claim 9, wherein said dipole magnet has a bending angle of 900.

12. The accelerator system as in claim 9, wherein the vacuum enclosure further comprises a magnetic lens located at either side of said dipole magnet.

13. The accelerator system as in claim 12, wherein said magnetic lens is a magnetic quadrupole multiplet or a magnetic solenoid.

14. The accelerator system as in claim 9, wherein said magnetic analyzer has focusing properties that create a focus in between said magnetic analyzer and an entrance of said accelerating tube.

15. The accelerator system as in claim 14, including a vacuum restriction means to minimize the flow of gas into said accelerator tube and wherein said focus created by said magnetic analyzer coincidences with said vacuum restriction means.

16. The accelerator system as in claim 1, wherein the high-energy ion beam consists of protons, deuterons or helium ions.

17. The accelerator system as in claim 1 including a vessel containing an insulating gas at a pressure of several more than one bar; said vessel also containing said high voltage terminal, said accelerating tube, and said pumping tube; and wherein said vacuum pump is located outside of said vessel.

18. The accelerator system as in claim 1 including a ground potential disposed outside of said vessel, and wherein said vacuum pump is located outside of said vessel and close to said ground potential.

19. The accelerator system as in claim 1, wherein said exit of said pumping tube is disposed close to said ground potential.

20. The accelerator system as in claim 1, wherein said accelerating tube extends straight from an entrance connected to said vacuum enclosure to a second end, said pumping tube extends straight from said high voltage end to said exit, and said pumping tube is parallel to said accelerating tube from said high voltage end to said exit.

* * * * *